United States Patent [19]

Back et al.

[11] 4,036,679

[45] July 19, 1977

[54] PROCESS FOR PRODUCING CONVOLUTED, FIBERIZED, CELLULOSE FIBERS AND SHEET PRODUCTS THEREFROM

[75] Inventors: Sangho E. Back; Imants Reba, both of Vancouver, Wash.

[73] Assignee: Crown Zellerbach Corporation, San Francisco, Calif.

[21] Appl. No.: 644,472

[22] Filed: Dec. 29, 1975

[51] Int. Cl.[2] ..... D21C 9/00

[52] U.S. Cl. ..... 162/9; 162/117; 162/149; 162/205; 241/28

[58] Field of Search ..... 162/9, 100, 232, 28, 162/26, 117, 149, 205; 241/28

[56] References Cited

U.S. PATENT DOCUMENTS

| | | | |
|---|---|---|---|
| 2,516,384 | 7/1950 | Hill et al. | 162/232 |
| 2,561,013 | 7/1951 | Coghill et al. | 162/232 |
| 2,943,012 | 6/1960 | Dunning et al. | 162/28 |
| 3,382,140 | 5/1968 | Henderson et al. | 162/28 |
| 3,596,840 | 8/1971 | Blomqvist | 241/28 |
| 3,661,328 | 5/1972 | Leask | 241/28 |
| 3,765,611 | 10/1973 | Steiniger | 241/28 |
| 3,809,604 | 5/1974 | Estes | 162/100 |
| 3,846,228 | 11/1974 | Ely et al. | 162/111 |

*Primary Examiner*—S. Leon Bashore
*Assistant Examiner*—William F. Smith
*Attorney, Agent, or Firm*—Jerome S. Marger; Corwin R. Horton

[57] ABSTRACT

A process is provided for producing novel convoluted, fiberized substantially nonfibrillated, cellulose fibers and novel sheet products from low moisture-content cellulose pulp, at a high through-put rate, which includes the application of contortive forces to a pulp mass under controlled operating conditions, wherein the feed rate, work space gap, and relative rate of movement of the working elements applying the contortive forces are correlated to maintain the work space filled with fibers under sufficient compression. Sheets made from these fibers exhibit excellent bulk, softness and absorbency properties, even when the formation process is conducted in an aqueous system, and even when substantial compacting forces are applied to the wet web processing.

22 Claims, 6 Drawing Figures

100 μm

100 μm

PROCESS FOR PRODUCING CONVOLUTED, FIBERIZED, CELLULOSE FIBERS AND SHEET PRODUCTS THEREFROM

BACKGROUND OF THE INVENTION

This invention generally relates to a process of subjecting low moisture content cellulose pulp to mechanical treatment which gives rise to structural deformation of the fibers, causing them to become convoluted, i.e., twisted and bent in a substantially lasting manner, without appreciably reducing the fiber length and without substantially decreasing the freeness of the pulp. At the same time in this process, the pulp is fiberized and fluffed so that the interfiber bonds between individual fibers, e.g., fiber bundles, which typically are created in drying the pulp are to a great extent broken and substantial disentanglement of the fibers results.

The prior art describes a number of methods of subjecting cellulose pulp to mechanical treatment for modifying the structure and configuration of the fibers by working a mass of fibers in a confined space between working elements. The conditions under which such methods are conducted differ considerably but, commonly, the pulp to be treated is in a substantially wet condition. By reason of the moisture content of the pulp so treated and the other operating conditions employed by the prior art processes, the degree and character of structural deformation which can be imparted to the fibers is limited. Moreover, these prior art processes do not at the same time fiberize and fluff the pulp to any significant degree. Indeed, these processes frequently tend to further entangle the individual fibers so that a separate fiberizing step is required.

One such prior art process of this type employs the so-called "Curlator" machine and is described in U.S. Pat. 2,516,384 to Hill et al. Other types of specific equipment for carrying out this process are described in U.S. Pat. No. 2,561,013 and 3,028,632, both to Coghill. In the Hill et al. process, cellulose fibers are "curled" to produce some degree of kinking, bending and twisting of the individual fibers. As opposed to conventional refining methods, this curling treatment does not substantially change the freeness of the pulp, but the tensile and bursting strengths decline as the stretch and tearing strengths, porosity and softness increase. In this process, cellulose pulp at a consistency between 2% and 60% is confined under mechanical pressure between two elements which are in relative gyratory or reciprocal motion creating nodules or balls of pulp between the opposed working elements. This gyratory action of the elements on the compressed nodules, which is quite different in nature and involves a generally less drastic application of forces than, for example, conventional refining, imparts the above described kinks, bends and twists to the pulp fibers. Thus, due to the limitations imposed by the need for gyratory or reciprocal motion, as well as the relatively high moisture content of the pulp, this process is inherently limited in through-put capacity. Moreover, the degree of fiber deformation is relatively low in the Hill et al. process and is such that any amount of convolution imparted to the fibers is quite limited. Thus, the fiber modification imparted by Hill et al. is not lasting in nature since an appreciable amount of the twists, kinks and bends transmitted to the fibers is dissipated on standing in about a 24- to 48-hour time period. Thus, deformation of the fibers in the Hill et al. process is mainly plastic in nature, the fibers tending to revert to their original configuration with time. This is believed to be at least partially due to the substantial amount of water that surrounds and is contained within the fibers, which tends to reduce the amount of lasting structural distortion which might otherwise result. Moreover, the fibers of the so-treated pulp are interlocked and intertwined so that a separate process step is required in order to fiberize the pulp as, for example, described in U.S. Pat. No. 3,809,604 to Estes.

Another such process, the so-called "high consistency refining", is described in U.S. Pat. No. 3,382,140 to Henderson et al. This process has the purpose of refining fibers by interfiber friction in order to increase tensile and burst strengths without decreasing tear strength. In this process, pulp at a consistency between 10% and 60% by weight is fed into a working space between two opposed, relatively rotating discs which confine the pulp therebetween under a pressure of from 5 to 20 pounds per square inch. The relative movement of the disc surfaces creates interfiber friction in the mass of confined fibers. The amount of work imparted to the fibers is quite substantial as measured by the energy input to the refiner, which may be as high as 60 horsepower days per ton. This interfiber frictional treatment refines the fibers, i.e., their surfaces are fibrillated and the tensile and burst strengths are substantially increased as the freeness of the pulp correspondingly decreases. This treatment also tends to kink and twist the fibers but such deformation is necessarily accompanied by fibrillation of the fibers, lowered freeness, etc., as previously mentioned. Moreover, the fibers of the treated pulp are interlocked and intertwined by the process such that a subsequent step is necessary to fiberize the pulp.

As mentioned, there are also various prior art processes for fiberizing and fluffing substantially dry pulp, the fibers of which are intertwined and bonded together. Thus, processes utilizing hammermills, pinmills or disc refiners may be employed for the purpose of separating an intertwined dry pulp mass into individual fluffed fibers having minimal reductions in fiber length and freeness. In general, these processes exhibit only a minor amount of fiber deformation. Typically, therefore, little actual work is imparted to the pulp in conducting these processes.

Processes in which a disc refiner is employed for purposes of pulp fiberizing are described in U.S. Pat. No. 3,596,840 to Blomqvist et al. and U.S. Pat. No. 3,802,630 to Lee et al. In these processes, dry pulp (in Blomqvist pulp with a consistency greater than 85%, and in Lee et al. at least 90%) is introduced into a disc refiner operated under conditions which will fiberize and fluff the pulp. In the case of Blomqvist et al. a fixed gap width is maintained between the refiner plates of between 0.1 to 5 mm and the pulp is fed into and through the gap entrained in a carrier gas stream. The fibers are separated by a rubbing or shearing action of the plates on the pulp. No information is provided as to the amount of work imparted to the fibers. However, it is apparent that little work or resulting fiber deformation is carried out since the fibers pass rapidly through the gap entrained in a gas stream and thus do not fill the work space to the extent that will permit exertion of sufficient pressure and accompanying forces on the pulp by the refiner plates to create fiber deformation. Similarly, in the process described in Lee et al. the operating conditions maintained between the plates are insufficient to permit the space between the plates to be filled with fibers under the requisite compression. Consequently, while interaction of the pulp with the refiner plates may be sufficient to fiberize the pulp, forces of a character and degree to twist and bend the fibers in a substantially lasting manner are not generated.

U.S. Pat. No. 3,301,746 to Sanford et al.; U.S. Pat. No. 3,432,936 to Cole et al.; and U.S. 3,821,068 to Shaw, all provide methods of forming soft, absorbent, bulky sheets employing techniques in which compaction of a wet web, prior to drying, is omitted since it is totally detrimental to proper sheet formation.

SUMMARY OF THE INVENTION

In contrast to the prior art described, the process of this invention treats cellulose pulp to produce fibers which are twisted and bent, i.e., convoluted, in an effective, efficient, and substantially lasting manner, without appreciable fiber length or freeness reduction and, in the same process step, to provide pulp which is substantially fiberized and fluffed. In the present process, low moisture content pulp is fed continuously at a high through-put rate into and through a work space formed between opposed spaced-apart working elements to a point of discharge from the work space, the elements including opposed surfaces capable of applying contortive forces to the pulp by engaging the fibers under controled operating conditions. As to the controled operating conditions of this process, the rate of feed of the pulp is correlated with the rate of relative movement of the working elements and the spacing between the surfaces of the working elements so as to maintain the work space filled with a mass of fibers under sufficient compression so that the pulp is engaged by the working surfaces and contortive forces are imparted to the fibers effective to produce convoluted fibers. The fibers thus treated are quite resilient and exhibit a relatively lasting structural deformation. Accordingly, the twists and bends imparted to the fibers are lasting in nature, sheets formed therefrom having a much greater average Young's modulus reduction than their untreated counterparts. Finally, the fibers produced by the process of this invention are substantially nonfibrillated, thereby minimizing significantly the amount of hydrogen bonding which might occur during sheet formation between respective adjacent cellulosic fibers. This results in sheets formed from the subject fibers which are softer, bulkier and more absorbent. Due to the presence of the convoluted, fiberized pulp, sheets can even be prepared in an aqueous system without substantially affecting these desirable properties, even if the wet web is compacted during the formation process.

DETAILED DESCRIPTION OF THE DRAWINGS

DETAILED DESCRIPTION OF PREFERRED EMBODIMENTS

Figure 1:
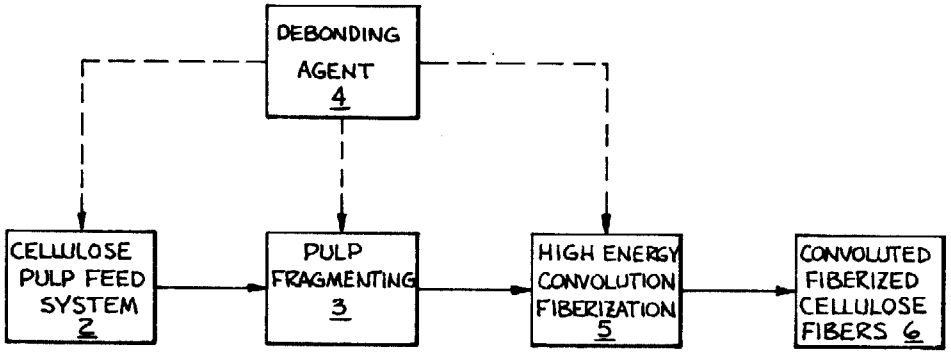
FIG. 1 is a schematic representation of the process for producing convoluted, fiberized pulp by the process of the present invention.

Referring to FIG. 1, a system 2 is employed for providing a low moisture content pulp feed capable of being convoluted and fiberized for use in the process of this invention. Suitable materials from which the low moisture content pulp can be derived include the usual species of coniferous pulpwood such as spruce, hemlock, fir, pine, and the like, as well as deciduous pulpwood such as poplar, birch, cottonwood, alder, etc. For example, cellulose fibers which have undergone some degree of lignin modification, such as by providing modified thermomechanical pulp, or at least partially chemically treated pulp, including for example, modified thermomechanical pulp heated to at least the glass transition temperature, chemimechanical pulp, semichemical pulp, chemical pulp, and the like, are all effectively employed in the process of this invention.

In general, low moisture content pulp which has not undergone a substantial fiber length reduction is employed as feed system 2. It is therefore preferable that feed system 2 be maintained at a minimum, average size fiber length sufficient to produce convoluted, fiberized fibers 6. Accordingly, pulp system 2 preferably has a weighted average fiber length of greater than about 1.0 mm, and more preferably greater than about 1.5 mm. TAPPI Standard 233-Su64 sets out the basis for calculating the value of weighted average fiber length in millimeters. In Volume 55, No. 2 of the January 1972 issue of TAPPI, a simplified method of calculating the average fiber length is set forth. The article, which is entitled "The Fiber Length of Bauer-McNett Screen Fractions", is written by J. E. Tasman, and appears on page 136 of aforementioned TAPPI publication. The simplified method should be used in computing the above weighted average fiber length values.

In order to produce convoluted, fiberized fibers, cellulose pulp 2 is subject to contortive forces at a low moisture level sufficient to concurrently preclude substantial fibrillation, and attendant strength, and bonding development, while also preventing substantial fiber damage and scorching. Thus, the consistency, i.e., the percent by weight on a dry basis of cellulose fibers in feed system 2, is desirably maintained at a level of at least about 60%, the approximate point above which fibrillation will not occur to any significant extent. However, in order to further minimize fibrillation, a consistency of from about 70%, and even from about 75%, is preferably employed. Similarly, a consistency of up to about 90% is desirably provided in order to avoid substantial scorching and/or significant fiber damage of the pulp feed. Again, in order to further minimize scorching and fiber damage, a consistency of up to about 85% is maintained.

Although the low moisture content of pulp 2 can be provided in various forms, as the previously described fibers, it is often supplied as a consolidated mass, such as bales, sheets, and the like. In general, the cellulose fibers will become entangled one with the other when they are dewatered by mechanical means and subsequently dried for purposes of increasing the pulp consistency to the requisite low moisture level. Accordingly, the pulp can be initially separated by means denoted "3" for fragmenting the above pulp bales, sheets, or entangled pulp, the overall amount of associated pulp fibers being reduced to a level at which effective feeding can readily take place. However, in the process of this invention, only a minimum amount of free fibers are generally present in the fragmentized feed stock. Typically, a hammermill, pinmill, or other like well-known devices are used for this initial fragmentation step. In the preferred form, the initially fragmentized pulp has a pulp density of less than about 15 pounds per cubic foot, and more preferably less than about 10 pounds per cubic foot.

A high energy means 5 for convoluting and fiberizing cellulose fibers is provided to treat pulp 2 for continuously producing a product which is twisted and bent at a relatively high through-put rate. The convolution-fiberization means 5 includes a work space formed between opposed spaced-apart working elements, the opposed surfaces of the working elements being capable of applying the requisite contortive forces to the pulp by engaging the fibers under controled operating conditions. An auxiliary means for conveying the pulp to the work space, such as a screw conveyor and the like, is provided for use herein. Desirably, the working elements are equipped with opposed coaxially disposed working surfaces in a generally facing relationship throughout the entire extent of the work space, at least one of the working surfaces rotating in a substantially fixed plane relative to the other. Preferably, a refiner, such as a disc refiner, is utilized as the means for providing the requisite high-energy forces to the pulp. For purposes of illustration, a single or double disc refiner, the general structure and manner of operation of which are described in the above cited Henderson et al. patent, U.S. Pat. No. 3,382,140, can be effectively employed herein.

In order to impart contortive forces capable of bending and twisting fibers in a lasting manner, the work space must be filled with a mass of pulp under a sufficient amount of compression. For purposes of illustration, as in the case of the disc refiner described in the above Henderson et al. patent, the compressive forces of the discs on the pulp can be calculated by determining the inwardly directed hydraulic pressure on disc 21 exerted by hydraulic piston 28. Then, by multiplying the hydraulic pressure by the cross-sectional area of the piston and dividing by the total area of the refining plate section 23, the pressure exerted on the pulp can be calculated. In order to be assured that the compressive forces exerted on the pulp are, in fact, sufficient to promote convolution and fiberization, a pressure is applied by means of the opposed surfaces which is preferably at least 10 pounds per square inch. And, although high positive pressures may be applied to the pulp, for purposes of optimum processing, it is preferred that a pressure up to about 25 pounds per square inch, and more preferably up to about 20 pounds per square inch, be employed.

The contortive forces applied to the fibrous feed must be of sufficient magnitude to produce convoluted fibers. One method of describing the magnitude of these contortive forces is in terms of the "net specific energy", i.e., the actual amount of energy applied in treating a given weight of pulp. More specifically, the net specific energy for a disc refiner is the gross energy, measured in brake horsepower days per air-dried ton (HPD/ADT), i.e., the daily horsepower required to produce one ton of pulp, imparted to low moisture content pulp, minus the energy imparted at idling load conditions. Thus, a given net specific energy calculation is made by the following equation:

$$\text{Net specific energy } (HPD/ADT) = \frac{\text{Net refiner power meter reading (kw-hr)} \times \text{Refiner motor efficiency} \times \text{2000\# pulp per ton} \times \frac{0.9\ ADT\ \text{pulp}}{ODT\ \text{pulp}}}{\frac{0.746\ \text{kw}}{\text{brake h.p.}} \times \frac{24\ \text{hr}}{\text{day}} \times \text{total pounds } O.D.\ \text{pulp}}$$

Therefore, the minimum net specific energy desirably employed is at least about 0.75 HPD/ADT. However, depending on the particular high energy means 5 employed, as well as the specific operating conditions employed, a preferably net specific energy of at least about 1.0 HPD/ADT, and more preferably at least about 1.5 HPD/ADT, is maintained.

It is known that both the low-consistency refining and high-consistency refining systems of the prior art cause varying degrees of reduction in freeness of the final pulp. Accordingly, it is totally unexpected, especially at the energy levels employed herein, that the freeness level is not substantially reduced but typically is maintained and in most cases is actually increased. More particularly, under preferred operating conditions, an increase in freeness of about 10%, and sometimes as high as about 15%, can be achieved.

The clearance between the opposed surfaces must be maintained at a spacing sufficient to preclude substantial fiber damage and thus, in general, must be wider than the fibers passing therethrough. Preferably, a spaccing of from about 0.04 inch to about 0.12 inch is maintained between the working surfaces, the exact spacing being correlated with the other operating conditions hereinafter described to preclude substantial fibrillation or scorching of the fibers.

The feed rate of pulp into the work space of high energy means 5 must also be controled and thus is maintained so that it is filled with fibers at a pressure adequate to create contortive forces, the absolute value again depending on the apparatus employed and the other operating conditions. In the case of a high energy means having coaxially disposed working surfaces, for instance, a desirable feed rate of from at least about 20 pounds per minute, and preferably at least about 30 pounds per minute, up to about 80 pounds per minute, and preferably up to about 60 pounds per minute, is provided to the work space at the above preferred operating conditions.

Under all conditions where the working elements are moving in a rotating manner, the relative tangential velocity of the working surfaces should be sufficiently great for any given operating conditions to impart contortive forces to the pulp within the work space. The relative movement between the opposed surfaces will vary, depending upon the type of high energy means 5 employed. In general, the working elements should rotate at a relative tangential velocity of not less than about 1,000 feet per minute. However, it is preferred that a relative tangential velocity of greater than about 5,000 feet per minute be employed to insure that contortive forces are actually applied to the pulp.

In describing the interdependency of the various operating conditions which interact to control the convolution-fiberization process in, for example, a disc refiner, a general relationship which can be expressed is that the operating conditions are directly proportional to the rate at which the pulp is continuously fed into and through the work space and that the contortive forces increase with an increase in the feed rate and/or in the work space pressure, respectively. Furthermore, at a given operating condition level the extent of convolution is inversely proportional (a) to the clearance between the respective working surfaces, (b) to the effective cross-sectional area of the work space entrance, and (c) to the relative rate of rotation of the working elements. In addition, the relative value of the operating variables can be adjusted in an indirect manner. Thus, the operator can adjust the feed at a given gap setting to raise or lower the net specific energy level so as to provide satisfactory contortive forces. If this net specific energy value drops below a predetermined figure, the operating conditions can be adjusted by changing the feed rate and/or gap setting to at least provide the above predetermined value.

In practice, for a given set of operating conditions, there is a demarcation level such that if the feed rate and/or pressure falls therebelow, at a given gap setting, the amount of contortive forces being applied to the pulp diminishes and the only effect being imparted to the fibers is one of fiberization with little or no convolution. It is therefore desirable to select conditions above this demarcation point for conducting the process of the present invention. A convenient way, therefore, of expressing the interrelationship of the various operating conditions for conducting both convolution and fiberization for a disc refiner operated at a relative rpm rate of 750–2,000 rpm is as follows.

$$\text{Operating Conditions (O.C.)} = \frac{F \times 10^3}{G\pi D_i \, rpm}$$

| | | |
|---|---|---|
| F | = | Feed rate, #/min |
| G | = | Clearance, inches |
| $D_i$ | = | Diameter of the refiner plates at the point of entry into the work space, in inches |
| rpm | = | Relative rate of rotation in rpm for given disc refiner |

Desirably, if the above relationship is employed as a measure of the operating conditions above which contortive forces would be maintained, a minimum level of at least about 3 pounds of dry pulp per square inch of effective cross-sectional area of work space per rpm is provided.

Since the opposed surfaces of the working elements forming the work space must be capable of engaging the pulp, it is desirable that their working surfaces be roughened. The roughening can generally be incorporated by fabricating the surfaces in various configurations including ducts, grooves, indentations, or projections. In an apparatus having opposed coaxially disposed working surfaces, as previously described, bars are the preferred form for the roughened surfaces and are found to impart a high degree of contortive forces to the pulp. When bars are employed, one useful measure of the effect of the bars in imparting contortive forces to the pulp is ICPM, the total inch contacts per minute that the bars of a given disc refiner contact the pulp. This calculation is set forth in McDonald, J. E., "Post Refining Standard New Groundwood for Rotogravure and Directory Pulps", Pulp and Paper Magazine of Canada, 75C: T105, March 1975. Preferably, the coaxially disposed rotatable working surfaces having bars projecting inwardly therefrom are rotated at a relative rate capable of providing an ICPM value of at least about $300 \times 10^6$, and more preferably at least about $750 \times 10^6$.

In order to minimize fiber damage and to decrease interfiber bonding between individual fibers, a debonding agent 4 can be added to the pulp feed 2 and/or to the fragmenting means 3 and/or to the high energy means 5. A reduction in the amount of interfiber bonding is also facilitated since the hereinafter described product fibers 6 are in a substantially nonfibrillated state. Typically, a cationic debonding agent, such as a cationic surfactant, is employed for this purpose. Preferably, from about 0.2%, and more preferably from about 1.0% of the debonding agent, based on the weight of ovendry (O.D.) pulp with which it is combined, is utilized. Generally, for reasons of economics, the maximum amount of debonding agent added is up to about 5.0%, and preferably up to about 2.0%.

The pulp 6 is recovered for subsequent formation into a sheet product after the fibers have been bent and twisted in a substantially lasting manner. This substantially lasting distortion which is imparted to the fibers accounts for the ability of the fibers to exhibit resiliency and low bonding intensity, and to undergo wet processing without being substantially affected by the mechanical pressing operations. Thus, as opposed to the prior art process of Hill et al., in which the curling effect imparted is appreciably dissipated in about a 24- to 48-hour period after formation, the contortive forces applied to the fibers in high energy means 5 are such that the structurally modified pulp, in the dry state, substantially retains its convoluted quality for a period of time appreciably in excess of 48 hours. If the hereinafter described wet-sheet-formation process is to be employed, an aqueous slurry of the treated fibers is first prepared since the slurry will generally be used in making the subject sheets within a relatively short period of time. However, if the convoluted, fiberized pulp is to be stored for a period of time in excess of about 24 hours, the pulp should desirably be maintained in a substantially dry state to avoid reversion of the treated pulp from its convoluted, fiberized state to a relatively untreated condition.

Figure 5:
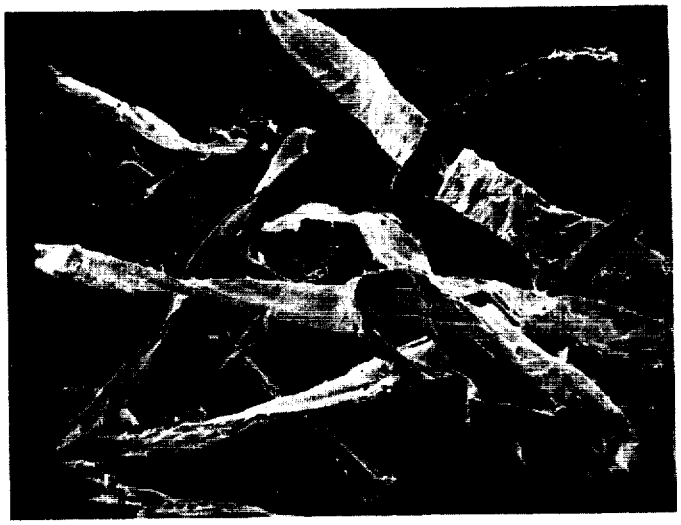
FIG. 5 is a photomicrograph enlarged 200 times, depicting untreated cellulose fibers in their nascent, flat, ribbon-like state.
Figure 6:
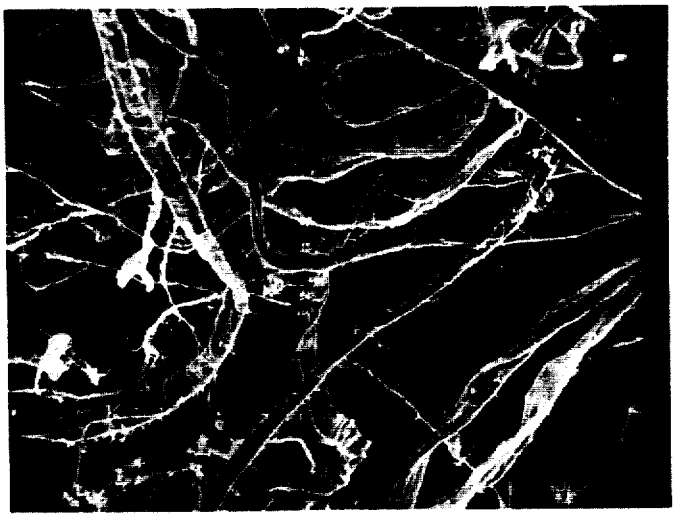
FIG. 6 is a photomicrograph enlarged 200 times of the fibers shown in FIG. 5, which have a substantially lasting, bent and twisted configuration due to the contortive action imparted by the convolution-fiberization process of the present invention.

The effect imparted to the fibers by convolution can be experimentally demonstrated by determining the average fiber width measurement before and after the convolution step. The individual fiber width is, therefore, reduced by employing the process of this invention which causes the flat ribbon-like fibers to become convoluted, thereby forming a controled, rolled fiber configuration which is substantially more resilient. Photomicrographs of the untreated and treated fibers, respectively, are depicted in FIGS. 5 and 6. The differences between fibers which have been convoluted and fiberized by the process of this invention, as compared to their untreated counterparts, are clearly manifested in the above photomicrographs.

The fiber width measurement is accomplished experimentally by sampling a thin slurry of pulp, on a random basis, and uniformly distributing same on a microscopic slide. Photomicrographs (enlarged 200 times) are then taken of representative areas, each having approximately 20 fibers in each fraction. Further enlargements are then made of these photomicrographs so that the fiber dimensions are then 80 times the original. Width measurements are made every 1-centimeter distance with the entire length of each fiber being traversed. A magnifying glass with a 10-millimeter reticle is used for the measurements. Therefore, the conditions under which convolution is conducted are correlated so that contortive forces are applied to the pulp resulting in an average fiber width reduction of preferably up to about 20%, and more preferably up to about 25% for convoluted fibers 6.

The change brought about by the process of the present invention regarding resiliency and fiber configuration are unexpectedly maintained during conventional wet processing and produce a sheet having excellent consumer-perceived softness, water absorbency, and bulk. Consumer-perceived softness development is evidenced to a great extent by a reduction in the Young's modulus of the sheet, i.e., the ratio of stress per unit area to the corresponding strain per unit length, the distortion of strain being within the elastic limit. More specifically, the reduction in the Young's modulus of a sheet made from convoluted fibers 6 can be demonstrated by determining the Young's modulus of a sheet formed from 100% convoluted fibers, and comparing it to the Young's modulus of a sheet made from similar fibers which are untreated. In general, when cellulose fibers 2 are treated according to the process of this invention, a reduction in the Young's modulus of sheets formed therefrom is provided to at least the minimum acceptable level necessary to achieve the above desired sheet properties. More specifically, sheets having a desired Young's modulus reduction level can be produced, for example, by admixing untreated fibers with convoluted, fiberized fibers 6, or by subjecting the untreated fibers to a sufficient degree of contortive forces necessary to achieve the desired sheet properties, and forming a sheet therefrom. Preferably, the desired Young's modulus reduction level for products such as tissue, toweling, and the like, is at least about 50%, and preferably about 75%.

Varying compositional amounts of convoluted, fiberized fibers 6 can be employed in forming a given product web. More specifically, the subject sheets can contain up to 100% of the subject fibers 6. Preferably, however, fibers 6 are blended with cellulosic papermaking fibers, the overall compositional amounts being generally determined by the nature of the ultimate properties desired in the sheet since commercial requirements of different products necessitate varying degrees of softness and strength, respectively. Thus, in order to maintain a desired strength softness balance, for example, in tissue or toweling use, filter media and saturation base paper, certain preferred compositional ranges for fibers 6 and cellulose papermaking fibers, respectively, are employed. It is desirable that the amount of the convolved, fiberized fibers in the sheet comprises from about 10%, up to about 70% by weight. However, for many products in which the fibers 6 are used, it is preferred that from about 20%, up to about 60% by weight, and more preferably up to about 40% by weight, based on the total weight of the fibers, be included.

Fibers 6 can be formed into a novel soft, absorbent, bulky sheet 15 by varying techniques. More specifically, the fibers are preferably processed by employing wet-formation techniques, more preferably conventional papermaking techniques, including standard wet compression of the sheet for dewatering purposes since capital costs will be minimized. However, dryform sheet products can also be prepared from fibers 6, employing air-laying techniques, for example, or other conventionally known dry-forming methods.

Figure 2:
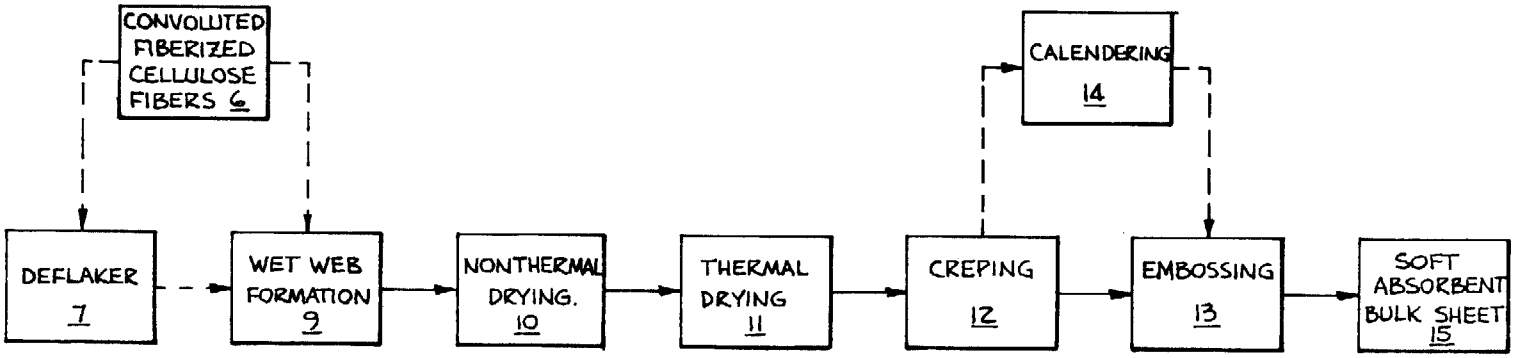
FIG. 2 is the process for making soft, absorbent, bulky sheet products from the convoluted, fiberized pulp according to the process of this invention.

For purposes of illustration, a typical method for the wet-processing of convoluted, fiberized fibers 6 is specifically outlined in FIG. 2. Optionally, fibers 6 can be added to a conventional deflaker 7 for purposes of removing any flake-like material which may be contained therein.

Figure 3:
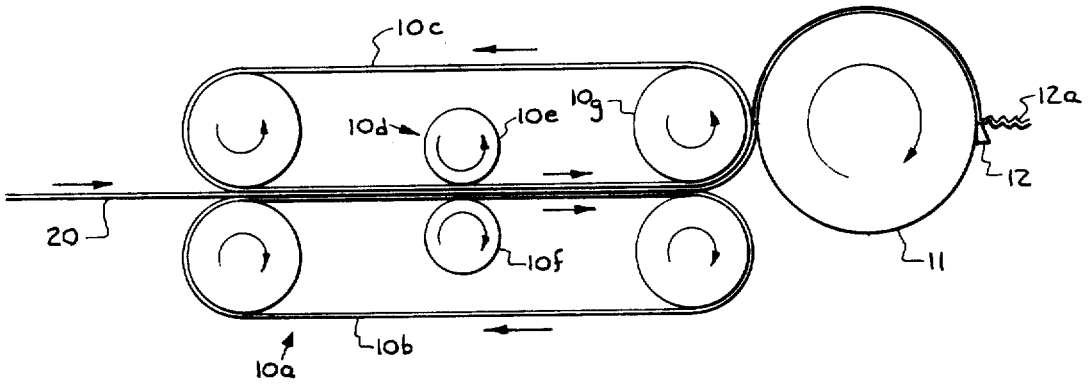
FIG. 3 is a schematic illustration of a preferred non-thermal-dewatering, thermal-drying sequence, according to the process of the present invention.

An aqueous slurry of the above fiber can be formed into a wet web 20 on a wet web-forming means, generally designated "9", preferably including a foraminous surface, such as a Fourdrinier, Stevens former, and the like. Although partial or total thermal-drying techniques can be employed, the product sheets are preferably prepared by first removing a substantial amount of water from the web 20 by nonthermal dewatering means 10 prior to being conveyed to the hereinafter described thermal-drying means 11. Nonthermal dewatering is possible because of the presence of the unique, convoluted, fiberized pulp 6 of this invention. This dewatering step is typically accomplished by various means for imparting mechanical compression to the web, such as by employing the conventional wet compression techniques as illustratively shown in FIG. 3. This mechanical compression step normally increases the compaction of the sheet to a level which is generally detrimental to a through-drying operation since it reduces the porosity of the sheet, which in turn decreases the drying effect thereby destroying the desirable combination of sheet properties required in tissue, toweling, and like sanitary products. The wet-formed web exits wet-forming apparatus 9 and is preferably conveyed to nonthermal dewatering means 10. In dewatering means 10, as shown in FIG. 3, the web 20 is typically initially "picked up" by a second foraminous conveying means **10*a*, preferably formed of top and bottom foraminous surfaces 10*b* and 10*c*, respectively. Then preferably, the web is introduced to a nonthermal dewatering means which subjects it to the compressive forces exerted by at least one dewatering means 10*d*, for example, rolls 10*e* and 10*f* and/or roll 10*g*, co-acting with drying cylinder 11. Rolls 10*f* and 10*g* are desirably vacuum-dewatering rolls although they may also be provided without vacuum. Roll 10*e* is typically a resilient press roll fabricated of hard rubber, metal, or the like. The wet web is carried by foraminous conveying means 10*a* through rolls 10*d* and 10*e*, and between roll 10*g* and drying cylinder 11, where it is preferably dewatered to a consistency of at least about 20%, and more preferably up to about 40%, and most preferably about 50%. The dewatered web is then applied to the drying cylinder 11, which is preferably a Yankee drying cylinder, by the compressive action of roll 10g** exerted thereon, as it brings the web in contact with the cylinder.

Because of the unique properties of convoluted, fiberized pulp 6, the resiliency, softness, bulk, and water absorbency properties of the web are maintained even though compressive forces are imparted thereto by nonthermal dewatering means 10. As specifically shown in Example 2, quite unexpectedly, this compressive action does not adversely affect the softness, absorbency, and bulk properties of sheets 15 which include fibers 6. In fact, sheets 15 are substantially better in these properties than sheets made from the same feed fibers which have not been subjected to the requisite contortive forces. Thus, sheets can be made employing fibers 6 in varying amounts, which are subjected to various levels of nonthermal dewatering, in which properties such as bulk, softness, water absorbency, etc., are maintained at a level comparable to their through-dried counterparts.

A relatively low density sheet can be provided at various levels of nonthermal dewatering when fibers 6 are utilized. The relative sheet density can be determined by calculating the difference, at a given nonthermal level of dewatering, between a sheet containing fibers 6 as compared to a sheet formed of similar cellulose fibers that have not undergone the subject treatment. Accordingly, the density of a sheet containing fibers 6 made by a conventional dewatering process, including nonthermal dewatering means, will desirably be comparable to a through-dried, uncompacted sheet. Preferably, a relative sheet density of at least 0.02 gram per cc, and more preferably a relative sheet density of at least 0.03 gram per cc, is provided at a given level of nonthermal dewatering.

Web 20 is then typically subjected to successive drying and creping steps, designated as "11" and "12", respectively. Generally, the dewatered web is first fed to thermaldrying means 11, such as a Yankee cylinder, as previously described, where the thermal-drying operation is conducted. A creping means 12 is then typically provided which, in general, comprises a doctor blade that simultaneously removes and crepes the sheet from the thermal dryer. In an alternative scheme, partial or complete through-drying of a substantially uncompacted web including convolved, fiberized cellulose fibers 6, prior to conveyance thereof to the Yankee cylinder, can also be provided. If desired, the creped sheet may be smoothed by calendering means 14 by passing the creped sheet between a pair of smoothing rolls.

Figure 4:
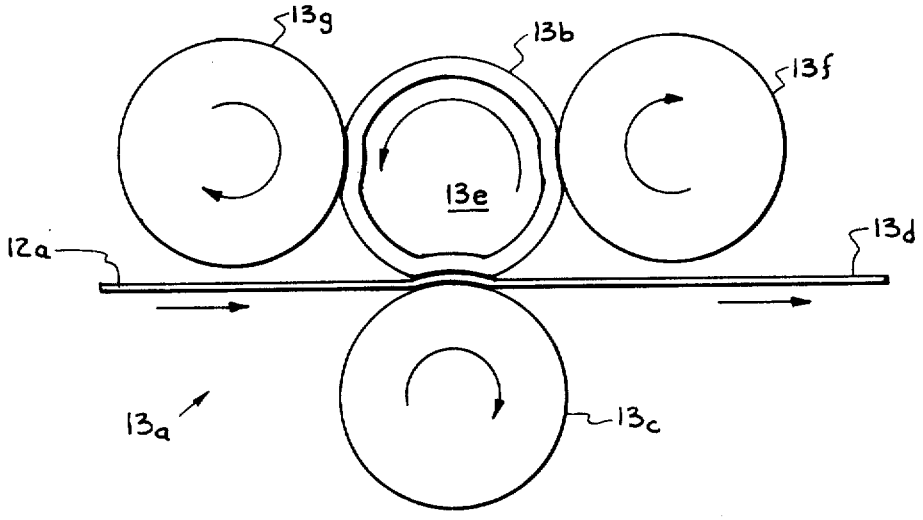
FIG. 4 is essentially a diagrammatic view depicting the cooperative interengagement of the embossing and platen rollers and the movement of a web advancing therethrough.

After creped sheet **12*a* is formed, an embossing step 13 is advantageously provided. Although standard embossing methods known in the prior art can be effectively employed, a further improvement in the bulk and softness of the sheet can be provided, using pneumatic embossing techniques. More specifically, as shown in FIG. 4, this improvement can be attained by employing embossing means 13*a*, which includes a resilient platen roll 13*b*, inflated with a gaseous substance 13*e*, which forms a nip in combination with a relatively rigid embossing roll 13*c*. Preferably, roll 13*c* has raised projections (not shown) on the roll periphery for producing an embossed sheet 13*d* when creped sheet 12*a* passes therebetween. The platen roll 13*b* is floatingly supported and confined by cooperative engagement with rolls 13*f* and 13*g*, respectively, as well as with resilient roll 13*c***.

The bulk softness of sheet 15 is measured by conducting a handle-o-meter test (HOM). The handle-o-meter test is described in TAPPI T-498. In order to convert this measurement to a more comparative figure for a given sheet, the HOM value is divided by the square of the caliper of a given single-ply sheet being tested, the quotient thereof being multiplied by $10^5$. For example, in tissue applications, depending on the type of furnish employed, bulk softness (the reciprocal of stiffness), expressed as HOM/(caliper)$^2 \times 10^5$, is desirably at least 0.25. Furthermore, in similar tissue applications, when a sheet which is somewhat more durable is wanted, a bulk softness of preferably at least 0.4, and most preferably at least 0.5 is produced. As to an upper limit, a bulk softness of up to preferably about 1.25 HOM/(caliper)$^2 \times 10^5$, and more preferably up to about 1.00, and most preferably up to about 0.75, is provided for a given sheet product, depending on the particular commercial end use.

However, regardless of the intended use of a given sheet, the presence of the subject fibers 6 in the furnish will serve to significantly reduce its stiffness when compared to sheets made from comparable, untreated fibers. Accordingly, the percent reduction in stiffness of sheets 15 is determined by comparing the stiffness of sheets containing treated and untreated fibers, respectively. Preferably, a percent reduction in sheet stiffness of at least 50%, and more preferably at least 100%, and most preferably, at least 200%, is provided herein.

The prior art thermal-drying processes previously cited are relegated to certain upper limits of basis weight since, if the basis weight of the sheet is above about 25–30 pounds per 3,000 square feet, drying to the requisite moisture level will be a serious problem. Contrarily, if the process of this invention is employed, sheets having extremely high basis weight, such as for use in high-bulk toweling and like products, can be provided. Thus, soft, absorbent, bulky sheets can be produced by the subject process which have basis weights up to about 100 pounds per 3,000 square feet. However, from a commercial standpoint, sheets 15 having a basis weight up to about 60 pounds per 3,000 square feet, and preferably up to about 50 pounds per 3,000 square feet, are most desirable.

Another property of sheet 15 which is of importance is its water absorbency. The water absorbency parameter is expressed as the number of seconds it takes for a single sheet 4.5 inches by 4.5 inches to absorb 0.1 cc of water, the test being described in TAPPI T-432. Generally, water absorbency of less than about 10.0 seconds will provide an adequate level for tissue application. However, it is preferred that a water absorbency level for tissue of less than about 8.0 seconds is provided, an instantaneous water pickup being most preferred.

EXAMPLE 1

The following series of experiments illustrates the process of the present invention and encompasses the system shown in FIGS. 1–3. By comparing the physical properties of sheets containing untreated cellulosic fibers (Run A) with sheets containing 100% of the same fibers which have been treated according to the process of the present invention (Runs B-E), the effect of employing the subject process is clearly demonstrated.

A blend of 75% hemlock and 25% fir kraft pulp in the form of 400- to 600-pound by weight pulp bales was mechanically shredded. The shredding means included counter-rotating drums each with teeth protruding therefrom, for purposes of initially fragmenting the bales nto smaller particles having a density of less than about 15 pounds per cubic foot. Less than 50% of the fragmentized pulp was in the form of free fibers and fiber bundles. Pulp was conveyed, through a metering system which measured the pulp feed rate, to a screw conveyor for feeding the fibers to a Bauer 411 disc refiner. In each case, the spacing between the refiner plates, the feed rate, the pressure applied to the pulp by the plates, and the refining power were adjusted to maintain the work space substantially filled with a mass of fibers so that the contortive forces for imparting a convolution-fiberization effect to the pulp were provided. More specifically, the pulp feed rate for Runs B-E of Table 1 was maintained at about 34 pounds per minute, while the gap setting in each case was narrowed beginning at from about 0.12 inch to 0.08 inch. This in turn caused the net specific energy level to increase from 1.43 HPD/ADT to 2.21 HPD/ADT. In each of the Runs B-E, the relative tangential velocity of the refiner plates was 24,558 feet per minute.

Medium-flat refiner plates, 40 inches in diameter, were employed in conjunction with the Bauer 411 disc refiner. The plates were designed having four radial bars spaced 15° apart with bars parallel to them on both sides in a 15° segment. The bars were five-sixteenths inch deep with the outer row of dams flush with the surface of the plate, eleven-sixty-fourths inch wide, with one-fourth inch wide grooves. Staggered dams were spaced 1¼ inches in the grooves and one-thirty-second inch below the surface of the plate.

The convoluted, fiberized pulp exiting the refiner was combined with enough water to make an aqueous slurry having a consistency of about 4%, which is relatively easy to pump. After deflaking the slurry in a Sprout Waldron deflaker, the pulp slurry was pumped to a headbox. A wet fibrous web was then formed by deposition of the aqueous slurry on the foraminous surface (wire) of a standard Fourdrinier paper machine system. The wet web was then conveyed from the foraminous surface of the Fourdrinier to a nonthermal dewatering system, more particularly, to a system for mechanically compressing the web. Specifically, the wet web was transferred to a pair of foraminous fabrics which carried the web into a nip formed by a pair of wet-press rolls for purposes of initial dewatering. The rolls, as employed herein, included an upper resilient rubber roll and a lower rubber-covered vacuum roll. The web was initially dewatered between the above rolls, by mechanical compression to a consistency of about 28–30%. The initially dewatered web was then carried via the conveying fabrics to a second nonthermal dewatering means comprising a second vacuum roll acting in cooperation with a standard Yankee drying cylinder. The sheet exited the second dewatering means at a consistency of about 35–40%. The action of the vacuum roll coacting against the Yankee cylinder on the sheet caused it to adhere to the Yankee cylinder where it was subsequently dried. The dried sheet formed on the Yankee was then creped as it was removed from the Yankee cylinder by a doctor blade, calendered between a pair of hard cylindrical rolls, and then formed into rolls for subsequent conversion. In this case, conversion included passing the rolled, dry sheet through a pneumatic embossing system including a gaseously-inflated resilient platen roll in combination with a relatively rigid embossing roll, having raised projections on the periphery thereof, to produce an embossing pattern on the sheet passing therebetween. The sheets were then perforated by a toothed blade, cut into the requisite tissue width, and then formed into standard tissue rolls. The conditions employed in forming the convoluted, fiberized cellulose pulp and the properties of the sheet formed according to the process of this invention are shown in Table 1.

TABLE 1

| Run Number | A (CONTROL) | B | C | D | E |
|---|---|---|---|---|---|
| Consistency* | — | 87% | 86% | 73% | 85% |
| Feed rate | — | 34#/min → | | | |
| Net specific energy HPD/ADT | — | 1.43 | 1.56 | 1.95 | 2.21 |
| Plate gap setting (inch) | — | 0.12 | 0.10 | 0.09 | 0.08 |
| ICPM | — | $9.85 \times 10^6$ → | | | |
| Pressure applied to pulp | — | 10 psi → | | | |
| Tensile oz/in | 27.3 | 14.2 | 9.4 | — | — |
| Caliper (single sheet in mils)** | 4.6 | 5.3 | 5.4 | 6.0 | 6.0 |
| % Sheet caliper increase | — | 15% | 17% | 30% | 30% |
| Density (g/cc) | 0.242 | 0.197 | 0.193 | 0.196 | 0.162 |
| Relative sheet density (g/cc) | — | 0.045 | 0.049 | 0.046 | 0.080 |
| Bulk softness $(HOM/Cal)^2 \times 105$ | 2.30 | 1.30 | 1.12 | 1.06 | 0.47 |
| % Reduction in stiffness | — | 77% | 105% | 115% | 390% |

*The consistency of the fibers entering the refiner were determined by measuring the consistency of the convoluted, fiberized pulp and correcting for the moisture loss caused during the refining step.

**Caliper measurements made by subjecting five test sheets to a psi force imparted by a 4-inch-diameter cylinder and dividing the reading in mils by 5. A total force of 1.35 psi was imparted to the sheets by the cylinder.

Clearly, significant differences are observed in the physical properties of sheets made from convoluted, fiberized pulp as compared to sheets containing only untreated fibers. Thus, the caliper of a single sheet made of treated fibers is from 15% to 30% bulkier than a comparable sheet formed of untreated pulp. Similarly, the relative densities of sheets formed according to the process of this invention are exhibited in the 0.045 to 0.080 range. Finally, the bulk softness, and accordingly the stiffness, of the respective sheets is dramatically different, percent reductions in stiffness of from 77% up to 390% being provided.

EXAMPLE 2

The following experiments were conducted in a similar manner to Example 1, except on a laboratory scale, employing a similar pulp feed (75% hemlock, 25% fir) at about an 89.2% consistency which previously was mechanically fragmentized in a hammermill to form the requisite fragmentized pulp. The pulp particles were conveyed to a Bauer 411 disc refiner at a feed rate of about 40 pounds per minute, a relative tangential velocity of about 24,558 feet per minute, and plate gap spacing of 0.105 inch. The refiner plates employed were similar to those described in Example 1. The net specific energy was 2.4 HPD/ADT.

A sample of the untreated feed fibers was then compared to the convoluted, fiberized material produced above, by wet-pressing a handsheet to a consistency of between 40–50%, the preferred upper limit of nonthermal dewatering, then the mechanically dewatered pulp formed into a 17-pound basis weight handsheet. Handsheets were also made from a similar amount of fibers which had not undergone treatment and both were processed in a like manner. Each mass of fibers was blended in 700 ml of water for 30 seconds at high speed in a Waring Blendor. The respective handsheets were then made by pouring the desired weight of fibers in a sheet mold and couching by standard techniques. Mechanical compression of 10 psi and 30 psi, respectively, was then applied to dewater each sheet to obtain a consistency of between 40% and 50% O.D. The handsheets were dried on a steam-heated rotary dryer for 2 minutes. The sheets were conditioned before testing at 50% relative humidity and 72° F. The following properties of the sheet were obtained:

TABLE 2

| Convoluted, fiberized pulp | 0% | 100% | 0% | 100% |
|---|---|---|---|---|
| Mechanical compression applied to sheet during dewatering (psi) | 10 | 10 | 30 | 30 |
| Consistency | 43.5 | 49.0 | 46.4 | 50.0 |
| Caliper (mils per single sheet) | 5.20 | 6.60 | 4.60 | 5.80 |
| Basis Weight | 16.8 | 17.6 | 16.9 | 18.1 |
| Density (g/cc) | 0.207 | 0.171 | 0.235 | 0.200 |
| Relative sheet density | — | 0.036 | — | 0.035 |
| Water absorbency (Sec/0.1 cc) | 147 | 3.6 | 210 | 4.1 |
| Tensile (oz/in) | 15.4 | 5.7 | 18.4 | 9.8 |
| Bulk softness (HOM/(Cal)$^2$ × $10^5$) | 1.47 | 0.55 | 1.65 | 0.96 |
| % Stiffness reduction | — | 168% | — | 72% |

The effect of employing the fibers produced by the process of this invention at high load wet-pressing is clearly shown above. Thus, the sheets containing 100% of convoluted, fiberized pulp showed significant improvements in caliper (26%), density (0.035 g/cc), water absorbency (over 300–400%) and percent stiffness reduction (72–168%).

EXAMPLE 3

The following experiments were conducted to demonstrate that modification of the fiber structure of the pulp produced by the process of this invention, which is lasting in nature, causes a substantial reduction to occur in the Young's modulus of sheets formed therefrom.

Handsheets were first made according to the techniques described in Example 2, and one-inch-wide strips, approximately six inches long, were cut therefrom. The strips were placed within the jaws of an Instron Model No. 1115 testing machine and secured in place. A test, similar to the tensile test described in TAPPI T-220, was then conducted in which the strip was elongated by the machine load exerted on them until the break point. The Young's modulus of the sheet was then calculated, employing the following equation:

$$E_c\,(\text{psi}) = \frac{(1{,}000)\,(F)\,(Lo)\,(V_2/V_1)}{(w)\,(d)\,(\text{caliper of the sheet})}$$

wherein

F is the maximum load reading

Lo = distance the respective machine jaws are separated $V_2$ = the chart speed of the recorder $V_1$ = the crosshead speed of the machine $w$ = the width of the sample strip $d$ = determined by drawing a straight line tangent to the load elongation curve, at the point of steepest slope, the horizontal distance from (a) the point at which the tangent crosses the x-axis and (b) the point at which a second line crosses the x-axis, said second line being drawn perpendicular from the point at which the tangent line crosses the horizontal axis through a given F Samples of both 100% hardwood (alder) and 100% soft-wood (75% hemlock, 25% fir) were subjected to the subject convolution-fiberization process and compared with their untreated counterparts. More specifically, the respective hardwood and softwood fibers were run employing a Bauer 411 disc refiner with similar plates to those used in Examples 1 and 2, and at a relative tangential velocity of 24,558 feet per minute, under the following conditions:

| | Hardwood | Softwood |
|---|---|---|
| Consistency | 84% | 75% |
| Feed rate (#/min) | 40.0 | 41.7 |
| Net specific energy (HPD/ADT) | 2.57 | 2.57 |
| Plate gap setting (inch) | 0.08 | 0.075 |
| Pressure applied to pulp (psi) | 20 | 20 |

The Young's modulus of the hardwood and softwood controls (untreated), respectively, were 27,085 psi and 66,667 psi, while sheets made from the treated pulp using the same fibers exhibited Young's modulus of 5,632 psi and 11,163 psi, respectively. Therefore, by employing the process of the present invention, the percent Young's modulus reduction exhibited by the convolved, fiberized hardwood and softwood fibers employed, was 380% and 500%, respectively.

Other physical properties of the above sheets were as follows:

| | Hardwood | Softwood |
|---|---|---|
| Tensile: | | |
| Untreated fibers | 28.4 | 10.1 |
| Treated fibers | 6.3 | 3.0 |
| Relative sheet density (g/cc) | .023 | .035 |
| Absorbency (Sec/0.1 cc) | 1.6 | 1.5 |
| Bulk softness (HOM/(Cal)$^2$ × $10^5$) | 0.28 | 0.92 |

EXAMPLE 4

Experiments were run at 70% and 82% consistency, respectively, in a manner as substantially described in Example 1, except that the subject sheet was made on a pilot-plant-scale conventional paper machine. Sheets made from furnishes containing 10%, 19%, and 36% by weight of the subject convoluted, fiberized cellulose fibers made from a mixture of 75% hemlock and 25% fir kraft fibers were compared with sheets made from a similar furnish containing none of the treated fibers. The untreated portion of the furnish comprised a 65% pulp mixture including 60% pine and 40% spruce kraft fibers, and 35% of a softwood kraft mixture including hemlock and fir. The above fiber furnishes were fed to the Bauer 411 refiner at a rate of 30 pounds per minute and at a gap setting of 0.11 inch. The bulk softness of each of the sheets made from the above furnish is as follows:

| Consistency | Subject fiber composition (% by weight) | Bulk softness (HOM/(Cal)$^2$ × $10^5$) |
|---|---|---|
| 70% | 0 | 1.25 |
| 70% | 10 | 1.04 |
| 70% | 19 | 0.86 |
| 70% | 36 | 0.86 |
| 82% | 0 | 1.25 |
| 82% | 10 | 0.95 |
| 82% | 19 | 0.83 |
| 82% | 36 | 0.75 |

It is clear from observing the test results of sheets made by the process of the present invention, at differing consistency levels, and at differing composition levels, that when the process of this invention is employed, a sheet having a higher bulk softness is provided.

EXAMPLE 5

The procedure of Example 4 was again repeated in an effort to determine in part the effect of the subject convolution-fiberization process on the freeness of the product fibers formed. Thus, the refining conditions to which the 75% hemlock, 25% fir kraft fibers were subjected in the Bauer 411 refiner were as follows:

| | A (Control) | B | C | D |
|---|---|---|---|---|
| Net specific energy (HPD/ADT) | — | 0.9 | 1.9 | 2.8 |
| Consistency | — | 86% | 87% | 87% |
| Feed rate (#/min) | — | 28.3 | → | |
| Relative tangential velocity (ft per min) | — | 24,558 | → | |
| Plate gap setting (inch) | — | 0.10 | 0.08 | 0.05 |
| Pressure applied to pulp (psi) | — | 10 | → | |
| Freeness (CSF) | 725 | 737 | 765 | 755 |

The properties of the sheets formed from the fibers described above are as follows:

| | A | B | C | D |
|---|---|---|---|---|
| Basis weight (lbs./3,000 ft$^2$) | 16.9 | 17.3 | * | 17.6 |
| Caliper, mils (single sheet) | 5.0 | 5.2 | 5.5 | 5.4 |
| Tensile (oz/in) | 27.7 | 21.5 | 10.4 | 4.3 |
| Bulk softness (HOM/(Cal$^2$ × 10$^5$) | 2.13 | * | 1.06 | 0.59 |

*Results not within range experienced in experiments run over a broad range of conditions.

Again, significant differences are observed in the physical properties of sheets made from convoluted, fiberized pulp as compared to sheets containing only untreated fibers.

Example 6

To demonstrate the average fiber width reduction effect imparted to fibers produced by the process of the present invention, a representative sample of the fibers produced in Example 1, Run E, were compared with the control fibers of Example 1, Run A. More specifically, a total of 674 measurements were made of 30 different feed fiber fraction samples of Example 1, Run A. The fibers selected were uniformly distributed on a microscopic slide. Photomicrographs (enlarged 200 times) were then taken of representative areas, each having approximately 20 fibers in the fraction sample. Further enlargements were then made of the photomicrographs so that the fiber dimensions were then 80 times the original. Using a magnifying glass with a 10-ml reticle, width measurements were made each 1 centimeter distance with the entire length of each fiber being traversed. Thus, it was found that the average fiber width of the control fibers was about 31.5 millimicrons. In a similar manner, 601 measurements were made of 30 fiber fraction samples of the convoluted, fiberized pulp produced in Example 1, Run E. In this latter case, the convoluted, fiberized pulp had an average width dimension of only 23.3 milimicrons, which constituted about a 25% reduction in the average fiber width. Moreover, statistical data indicated that convolution produced aa variability in the width of the respective fibers sampled.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow:

We claim:

1. A process for producing convoluted, fiberized cellulose fibers which are twisted and bent in a substantially lasting manner, without appreciable reduction of fiber length or freeness, comprising subjecting low moisture content cellulose pulp at a consistency of from about 70%, up to about 90% by weight, based on the dry basis weight of the pulp, said consistency being sufficient to preclude substantial fibrillation and the attendant strength and bonding development, while at the same time preventing fiber damage and scorching, to mechanical treatment which gives rise to structural deformation of the fibers causing them to become convoluted and at the same time fiberizing and fluffing the pulp, the mechanical treatment including continuously feeding the pulp at a relatively high throug-put rate into and through a work space formed between opposed, spaced apart working elements to a point of discharge from the work space, the elements including opposed surfaces capable of engaging the pulp, the feeding step being conducted at a rate correlated with the rate of relative movement of the working elements and the spacing between the working surfaces so as to maintain the work space filled with a mass of fibers under sufficient compression so that the pulp is engaged by the working surfaces and contortive forces are imparted to the fibers which are effective to produce convoluted, fiberized fibers which are substantially nonfibrillated.

2. The process of claim 1, wherein in order to further minimize and prevent fiber damage and scorching, the low moisture content cellulose pulp is maintained at a consistency from about 70% up to about 85% by weight.

3. The process of claim 1, wherein the magnitude of the contortive forces applied to the pulp within the work space by the working surfaces is at least about 0.75 HPD/ADT.

4. The process of claim 1, wherein the amount of compression applied to the mass of fibers filling the work space by the opposed working elements so that the pulp is engaged by the working surfaces and contortive forces are imparted to the fibers is at least 5 pounds per square inch.

5. The process of claim 1, wherein the contortive forces applied to the fibers filling the work space are such that the convoluted, fiberized cellulose fibers produced, in the dry state, substantially retain their convoluted quality for a period of time of appreciably in excess of 48 hours.

6. The process of claim 1, wherein the contortive forces imparted to the fibers are sufficient to cause a reduction in the Young's modulus of sheets produced from said convoluted, fiberized cellulose fibers of at least about 50% as compared to the Young's modulus of sheets made from similar fibers which have not been subjected to said contortive forces.

7. The process of claim 1, wherein the working elements are equipped with opposed co-axially disposed working surfaces in a generally facing relationship throughout the entire extent of the work space, at least one of the working surfaces rotating in a fixed plane relative to the other.

8. The process of claim 7, wherein the rotatable working surfaces include bars projecting inwardly therefrom, and rotating at a relative rate capable or providing an ICPM value of at least about $300 \times 10^6$.

9. The process of claim 1, wherein the operating condition is maintained at a level of at least about 3 pounds of pulp per square inch of effective cross-sectional area of work space per rpm.

10. The process of claim 7, wherein the feed rate is correlated with the spacing between the working surfaces and the rate of relative movement of the working elements so as to maintain the work space filled with a mass of pulp under sufficient pressure and contortive forces being imparted to the fibers, the feed rate being at least about 20 pounds per minute up to about 80 pounds per minute, and the spacing between the working surfaces being at least 0.04 inch up to about 0.12 inch.

11. The process of claim 8, wherein the tangential velocity of the working surfaces sufficient to impart contortive forces to the pulp within the work space is such that the working elements rotate at a relative tangential velocity of not less than about 1,000 feet per minute.

12. A process for making a soft, absorbent, bulky paper sheet which comprises:

a. producing convoluted, fiberized cellulose fibers which are twisted and bent in a substantially lasting manner, without appreciable reduction of fiber length or freeness, by subjecting low moisture content cellulose pulp at a consistency of from about 70%, up to about 90% by weight, based on the dry basis weight of the pulp, said consistency being sufficient to preclude substantial fibrillation and the attendant strength and bonding development, while at the same time preventing fiber damage and scorching, to mechanical treatment which gives rise to structural deformation of the fibers causing them to become convoluted and at the same time fiberizing and fluffing the pulp, the mechanical treatment including continuously feeding the pulp at a relatively high through-put rate into and through a work space formed between opposed, spaced-apart working elements to a point of discharge from the work space, the elements including opposed surfaces capable of engaging the pulp, the feeding step being conducted at a rate correlated with the rate of relative movement of the working elements and the spacing between the working surfaces so as to maintain the work space filled with a mass of fibers under sufficient compression so that the pulp is engaged by the working surfaces and contortive forces are imparted to the fibers which are effective to produce convoluted, fiberized fibers which are substantially nonfibrillated;

b. forming an aqueous fiber furnish including said convoluted, fiberized cellulose fibers;

c. forming a wet web from said aqueous fiber furnish; and d. thermally drying said wet web to form said soft, absorbent, bulky paper sheet, said sheet having a basis weight of from about 5 pounds per 3,000 square feet up to about 100 pounds per 3,000 square feet, and a bulk softness of from about 0.25 HOM/(caliper)$^2 \times 10^5$ up to about 1.25 HOM/(caliper)$^2 \times 10^5$.

13. The process of claim 12, wherein a substantial amount of water is removed from said web, prior to said thermal-drying step, by nonthermal dewatering means.

14. The process of claim 13, wherein said nonthermal dewatering means comprises means for applying mechanical compression to said web.

15. The process of claim 12, wherein said aqueous furnish includes convoluted, fiberized cellulose fibers and cellulosic papermaking fibers, respectively.

16. The process of claim 15, wherein said sheet is comprised of up to about 70% by weight of said convoluted, fiberized cellulose fibers, based on the total weight of fibers in said sheet.

17. The process of claim 13, wherein the consistency of the web, after being subjected to said nonthermal dewatering step, is from about 20%, up to about 60% by weight, based on the total weight of fibers in said web on a dry basis.

18. The process of claim 12, wherein the reduction in the Young's modulus of the soft, absorbent, bulky sheet product made from fibers which have undergone said mechanical treatment is at least 50%, as compared to the Young's modulus of a sheet made from similar fibers which are untreated.

19. The process of claim 12, wherein the conditions under which convolution is conducted is correlated so that contortive forces are applied to the pulp resulting in an average fiber width reduction of up to about 20% from their original flat, ribbon-like state.

20. The process of claim 12, wherein said bulk softness is from about 0.4 HOM/(caliper)$^2 \times 10^5$, up to about 1.00 HOM/(caliper)$^2 \times 10^5$.

21. The process of claim 12, wherein after said wet web is thermally dried, the dried sheet is pneumatically embossed to improve the bulk and softness of said dried web.

22. The process of claim 12, wherein a percent reduction in sheet stiffness of at least about 50% is provided for sheets subjected to said mechanical treatment as compared to the stiffness of sheets made from comparable, untreated fibers.

* * * * *